US008298753B2

(12) United States Patent
Staub et al.

(10) Patent No.: US 8,298,753 B2
(45) Date of Patent: Oct. 30, 2012

(54) METHOD OF GENERATING A LASER MARK IN A SECURITY DOCUMENT, AND SECURITY DOCUMENT OF THIS KIND

(75) Inventors: Rene Staub, Hagendorn (CH); Wayne Robert Tompkin, Baden (CH); Achim Hansen, Zug (CH); Andreas Schilling, Hagendorn (CH); Olaf Krolzig, Beinwill am See (CH); Daniel Holliger, Baar (CH)

(73) Assignee: OVD Kinegram AG, Zug (CH)

( * ) Notice: Subject to any disclaimer, the term of this patent is extended or adjusted under 35 U.S.C. 154(b) by 748 days.

(21) Appl. No.: 12/309,669

(22) PCT Filed: Jul. 24, 2007

(86) PCT No.: PCT/EP2007/006560

§ 371 (c)(1),
(2), (4) Date: Jun. 23, 2009

(87) PCT Pub. No.: WO2008/012061

PCT Pub. Date: Jan. 31, 2008

(65) Prior Publication Data

US 2009/0315316 A1 Dec. 24, 2009

(30) Foreign Application Priority Data

Jul. 25, 2006 (DE) ..... 10 2006 034 854

(51) Int. Cl.

| | |
|---|---|
| ***B42D 15/10*** | (2006.01) |
| ***B44F 1/12*** | (2006.01) |
| ***G07D 7/12*** | (2006.01) |

(52) U.S. Cl. ..... 430/321; 430/1; 430/2; 430/320; 283/86; 283/94

(58) Field of Classification Search ..... None
See application file for complete search history.

(56) References Cited

U.S. PATENT DOCUMENTS

| | | | | |
|---|---|---|---|---|
| 3,832,547 | A * | 8/1974 | Silverman | 250/319 |
| 4,287,572 | A * | 9/1981 | Webster | 365/128 |
| 4,459,020 | A * | 7/1984 | May et al. | 355/132 |
| 4,511,616 | A | 4/1985 | Pitts et al. | |
| 4,673,626 | A * | 6/1987 | Takeda et al. | 430/14 |
| 4,863,819 | A * | 9/1989 | Drexler et al. | 430/14 |

(Continued)

FOREIGN PATENT DOCUMENTS

| | | |
|---|---|---|
| DE | 4410431 | 9/1995 |

(Continued)

OTHER PUBLICATIONS

Technical Information—"Teslin® Substrate", 1 page (no date, downloaded Apr. 25, 2012).*

*Primary Examiner* — Martin Angebranndt
(74) *Attorney, Agent, or Firm* — Hoffmann & Baron, LLP

(57) ABSTRACT

The invention relates to a method of generating a laser marking in a security document by means of at least one laser beam, the security document having at least one laser-markable layer and also at least one reflecting layer which overlaps at least partly with the at least one laser-markable layer and has opaque regions. The at least one reflecting layer has at least one transparent region and, at least visually, is not significantly altered by the laser treatment of the laser-markable layer.

54 Claims, 6 Drawing Sheets

U.S. PATENT DOCUMENTS

| | | | | |
|---|---|---|---|---|
| 5,304,789 | A * | 4/1994 | Lob et al. | 235/487 |
| 5,340,637 | A * | 8/1994 | Okai et al. | 428/167 |
| 5,747,225 | A * | 5/1998 | Manico et al. | 430/345 |
| 6,082,778 | A | 7/2000 | Solmsdorf | |
| 6,505,779 | B1 * | 1/2003 | Power et al. | 235/488 |
| 2003/0136847 | A1 | 7/2003 | Braun | |
| 2004/0043308 | A1 | 3/2004 | Lutz et al. | |
| 2004/0048172 | A1 * | 3/2004 | Fischer | 430/15 |
| 2004/0076802 | A1 * | 4/2004 | Tompkin et al. | 428/174 |
| 2004/0265552 | A1 | 12/2004 | Lutz et al. | |
| 2005/0118537 | A1 | 6/2005 | Lutz et al. | |
| 2005/0185280 | A1 * | 8/2005 | Kaule | 359/566 |
| 2007/0273142 | A1 * | 11/2007 | Tompkin et al. | 283/72 |
| 2008/0191462 | A1 * | 8/2008 | Depta et al. | 283/110 |

FOREIGN PATENT DOCUMENTS

| | | | |
|---|---|---|---|
| DE | 10054803 | | 5/2002 |
| DE | 10139719 | | 5/2002 |
| DE | 10154051 | | 6/2002 |
| EP | 1747905 | * | 1/2007 |
| GB | 1518946 | * | 7/1978 |
| JP | 61-220148 | * | 9/1986 |
| JP | 01-224186 | * | 9/1989 |
| JP | 06-075517 | * | 3/1994 |
| WO | WO 01/62509 | | 8/2001 |
| WO | WO 02/36357 | | 5/2002 |
| WO | WO 03/095226 | | 11/2003 |

* cited by examiner

METHOD OF GENERATING A LASER MARK IN A SECURITY DOCUMENT, AND SECURITY DOCUMENT OF THIS KIND

This application claims priority based on an International Application filed under the Patent Cooperation Treaty, PCT/EP2007/006560, filed on Jul. 24, 2007 and German Application Nos. DE 102006034854.0, filed on Jul. 25, 2006.

BACKGROUND OF THE INVENTION

The invention relates to a method of generating a laser marking in a security document by means of at least one laser beam, the security document having at least one laser-markable layer and also at least one reflecting layer which overlaps at least partly with the at least one laser-markable layer and has opaque regions.

The introduction of laser marks in security documents of this kind as protection against copying is known from DE 44 10 431 A1. An identity card or similar data carrier is in this case formed with a laser-markable layer, a reflecting metal layer and a transparent card covering layer, in this sequence. With the aid of a laser beam, congruent identifications are introduced through the card covering layer into the reflecting metal layer and the laser-markable layer. The laser-markable layer may in this case be applied as a coating on a card core layer, the reflecting metal layer not covering the laser-markable layer completely and it consequently being possible for identifications to be introduced not only into the reflecting metal layer but also into the laser-markable layer.

Furthermore, a method of producing a data carrier which has a laser-markable layer and a transparent, optically variable layer overlapping at least in certain regions therewith is known from WO 01/62509 A1. Optically variable layers give different impressions, such as for example show different colors, from different viewing angles. The transparent, optically variable layer is arranged on the side of the laser-markable layer that is facing the viewer and is largely transparent to the laser radiation that is used. With a laser beam, visually perceptible markings, in particular black markings, are recorded in the laser-markable layer through the optically variable layer, the optically variable effect being clearly visible in particular in the regions of the optically variable layer that lie over the laser marking generated. By contrast, the optically variable effect is less clearly visible in the other regions of the laser-markable layer that are covered by the optically variable layer.

Security elements with opaque, reflecting regions according to DE 44 10 431 A1, on the other hand, are visually clearly recognizable independently of the background, on account of the high reflectivity of the opaque metal regions. The reflecting metal layer is cut through congruently during the laser marking of a laser-markable layer arranged thereunder, so that in the openings produced in the reflecting metal layer only material that has been altered by the laser irradiation is visible. It is not possible to produce an informational content of the laser marking in the laser-markable layer that is independent of the formation of the openings in the reflecting metal layer.

SUMMARY OF THE INVENTION

It is therefore the object of the invention to provide a method of generating a laser marking in a security document and a security document produced by this method which makes stronger optical impressions than before possible.

For the method of generating a laser marking in a security document by means of at least one laser beam, the security document having at least one laser-markable layer and also at least one reflecting layer which overlaps at least partly with the at least one laser-markable layer and has opaque regions, the object is achieved by the at least one reflecting layer being formed, at least in an overlapping region in which the at least one reflecting layer and the laser-markable layer overlap, seen perpendicularly to the plane of the reflecting layer, with at least one transparent region surrounded on at least two sides by an opaque region of the at least one reflecting layer, by the at least one reflecting layer being arranged between at least one laser radiation source for the at least one laser beam and the at least one laser-markable layer, and by the laser marking being generated in the at least one laser-markable layer such that it is visually recognizable through the at least one transparent region, the at least one reflecting, layer being retained at least visually largely unaltered.

The method according to the invention makes it possible to introduce a laser marking into a laser-markable layer without altering the visual impression, or only partly altering the visual impression, of a reflecting layer with opaque or semi-transparent regions and transparent regions that is consequently over the laser-markable layer in the path of the laser beam during the laser marking. This means that the reflecting layer may indeed be altered slightly, but this should not be recognizable for the viewer visually, that is to say without further aids such as magnifying glasses, microscopes or the like. A slight alteration in the visual impression, for example in the reflection behavior, may even be desired as an additional special security effect. The opaque regions of the at least one reflecting layer achieve optical effects of a strong impression that can be excellently recognized independently of the background. In the semi-transparent or transparent regions of the at least one reflecting layer that are formed at least largely such that they are transparent to the laser beam used, the laser marking of the laser-markable layer lying thereunder that was introduced through the transparent regions becomes visible. In this case, optically for the viewer, the laser marking preferably extends over a number of semi-transparent or transparent regions that are separated from one another by opaque regions.

For a security document that can be obtained in particular by the method according to the invention and has at least one laser-markable layer and also at least one reflecting layer which overlaps at least partly with the at least one laser-markable layer and has opaque regions, the at least one reflecting layer being formed, at least in an overlapping region in which the at least one reflecting layer and the laser-markable layer overlap, seen perpendicularly to the plane of the reflecting layer, with at least one transparent region surrounded on at least two sides by an opaque region of the at least one reflecting layer, the object is achieved by a contiguous laser marking in the laser-markable layer, spanning at least two transparent regions, being visually recognizable for a viewer in at least two adjacent transparent regions, the laser marking being formed independently of the configuration of the transparent regions in the reflecting layer, and by the laser marking in the laser-markable layer being interrupted under the opaque regions such that this is not visually recognizable for the viewer.

This visually gives the impression that the laser marking was already present in the laser-markable layer before the application of the at least one reflecting layer to the laser-markable layer.

Generally, alphanumeric characters or strings of characters, symbols, logos, images, photos, captions, lines, biometric data such as fingerprints or the like are permanently recorded in the laser-markable layer with the at least one laser beam as identifications or markings.

Identity passes, passports, identity cards, bank cards, tickets, documents of values such as banknotes, etc. are understood in particular as security documents. The laser beam serves for individualizing or personalizing a security document or document of value, in that personal data such as name, date of birth, address, signature, photograph, etc., or other data such as serial numbers, bar codes, etc., are generated on the document. In this case, generally black-and-white markings, gray-scale images, color images or color markings may be formed.

A metal layer is used with preference as the reflecting layer, but colored semiconductor layers, such as for example layers of silicon, germanium or lead sulfide, are also suitable.

It has proven successful if the opaque regions of the at least one reflecting layer, seen perpendicularly to the plane of the reflecting layer, are formed as a pattern and/or a grid and/or an area of parallel and/or wavy lines. Furthermore, the opaque regions may form a dot matrix, which may have the same or different matrix spacings and/or the same or different matrix dot sizes.

The at least one transparent region is preferably surrounded by opaque regions on all sides.

An at least significant visual impairment of the at least one reflecting layer in the opaque regions is effectively avoided during the laser marking by the at least one reflecting layer being formed in the opaque regions with a thickness in the range from 0.2 to 150 μm and by the at least one laser beam for generating the laser marking being passed over the opaque regions of the at least one reflecting layer and the at least one transparent region.

On account of the quite high density of the at least one reflecting layer in the opaque regions, in comparison with reflecting layers that are usually used on security elements, the reflecting layer material is vaporized or damaged only partly, or not at all, there during the laser irradiation when the at least one laser beam crosses over the opaque regions. If the heat dissipation of the thick reflecting layer is adequately high, the reflecting layer is not vaporized in the opaque regions. In any event, after the crossing over of an opaque region, a sufficiently thick reflecting layer remains in the opaque regions to be visually equivalent or virtually equivalent to opaque regions not crossed over by the laser beam.

It has in this case proven successful if the material for forming the at least one reflecting layer absorbs the laser radiation as little as possible. Preferably, the at least one reflecting layer is formed as a metal layer, in particular from silver, gold, aluminum, nickel, chromium, copper, etc.

The reflecting layer may also be a multi-layer structure comprising at least two layers of different materials arranged congruently one on top of the other. For example, a thin, optically attractive reflecting layer, which is visible for the viewer, may be combined with a thick, optically less attractive reflecting layer, which is not intended to be visible and serves in particular for heat dissipation.

Furthermore, a diffractive relief structure, which has the effect in particular of reducing the absorption of the laser beam, may be arranged in opaque regions of the reflecting layer.

A visual impairment of the at least one reflecting layer in the opaque regions is also largely avoided during the laser marking by a positional detection of at least parts of the opaque regions of the at least one reflecting layer being carried out, by the at least one laser beam for generating the laser marking being controlled on the basis of data determined from the positional detection in such a way that the at least one laser beam for generating the laser marking does not at any point impinge on the opaque regions of the at least one reflecting layer. In the control of the laser beam path, the opaque regions are consequently completely omitted and not impinged with the laser radiation.

Alternatively, a lowering of the power of the laser beam takes place in the opaque regions of the reflecting layer.

Preferably, the positional detection is in this case carried out optically. In this case, the position of the opaque regions is optically detected, at least in certain regions, by means of a sensor unit and the data determined are transmitted to a computing unit. The computing unit controls the laser on the basis of the data.

In this case, there is on the one hand the possibility of a positional detection taking place merely at selected points and a reference image of the opaque regions being stored in the computing unit. A synchronization of the determined data with the stored reference image of the opaque regions then takes place, it being possible for any distortions of the opaque regions with respect to the reference image to be detected and taken into account in the control of the laser beam. The actual position of all the opaque regions, calculated by means of the synchronization, is taken as a basis for the control of the laser beam, opaque regions being omitted from the laser treatment or impinged with a laser beam of reduced power.

On the other hand it is possible, in particular with a camera, to perform direct optical detection of the position of all the opaque regions, but in particular of the opaque regions that lie in the laser path of the laser beam for forming the laser marking. The detected image of all the opaque regions of the at least one reflecting layer produces the required data to control the laser correspondingly and to omit opaque regions from the laser treatment or to impinge on them with a laser beam of reduced power. This is of advantage in particular if the opaque regions vary, for example on account of production tolerances, the formation of individual or personal data or a Kinegram®.

If only the opaque regions that lie in the laser path of a laser beam for forming the laser marking are to be detected, the laser path to be covered, for example in the form of a signature or a serial number, must already be stored as a data record in the computing unit. On the basis of the data record, an optical scanning of the laser-markable layer takes place at all the points intended to be covered by the laser beam for generating the at least one laser marking. At points at which the presence of opaque regions is determined during the scanning, data are generated and these data are used for controlling the laser beam, so that no laser treatment, or laser treatment of reduced power, takes place in the region of the opaque regions. As a result, any distortions of the opaque regions of the reflecting layer are compensated directly.

It has proven successful if the at least one reflecting layer is formed with at least one optically detectable positional marking and a position of the positional marking is determined or, independently of the reflecting layer, at least one optically detectable positional marking is formed on the security document and a position of the positional marking is determined. Diffractive markings, printed markings, markings generated by means of the laser, machine-readable markings, such as markings detectable by infrared radiation, magnetic markings, etc., are suitable as positional markings. The reflecting layer itself may be formed with opaque regions in the form of arrows, bars, dots, etc. to form positional markings.

Preferably, the at least one reflecting layer or the security document is formed with at least three optically detectable positional markings and the position of the at least three positional markings is determined to make it possible to detect and compensate for a distortion of the at least one reflecting layer that may have occurred when the at least one reflecting layer was applied to the at least one laser-markable layer.

A visual impairment of the at least one reflecting layer in the opaque regions is also effectively avoided during the laser marking by at least one detection laser beam being coupled into the at least one laser beam for generating the laser marking or is directed parallel to the at least one laser beam, and by a lowering of the power of the at least one laser beam for generating the laser marking, or switching off of the same, taking place when the at least one detection laser beam detects the presence of opaque regions of the at least one reflecting layer. In the converse case, an increase in the power of the at least one laser beam for generating the laser marking, or switching on of the same, takes place.

If laser radiation of a different wavelength is used for the detection laser beam and the laser beam for generating the laser marking, it must be noted that the radiation is deflected differently wavelength-dependently, so that a "spatial" correction must take place between the position of the opaque regions detected with the detection laser beam and the position actually to be omitted from the irradiation by the laser beam for generating the laser marking. The detection laser beam may be arranged coaxially with the laser beam for generating the laser marking. Alternatively, however, the detection laser beam may also be aligned such that it is angled with regard to the laser beam for generating the laser marking, both the detection laser beam and the laser beam for generating the laser marking being directed at a common point of the reflecting layer.

However, a single laser operated in different modes may also assume the function of a detection laser beam and a laser beam for generating the laser marking. If the laser beam is moved to a new position of the reflecting layer, the power of the laser is set to a value below the power limit value from which ablation occurs, and the direct or diffuse reflection of the power-reduced laser beam is measured at this position. If a transparent region with low reflection or without reflection is established, the power of the laser is increased and the laser marking is generated in the laser-markable layer at the position chosen. Otherwise, the laser is moved on without changing the power and the measurement is repeated at the next point.

As an alternative to control of the power of the laser beam, control of the speed of movement of the laser beam may also take place, in order to achieve an exposure time of the opaque regions to the laser beam that is as short as possible. This is meaningful at present in particular for relatively wide opaque regions, which are to be crossed over by the laser beam in an accelerated manner.

A further possibility for excluding opaque regions of the reflecting layer is to use a mask, which is arranged in the path of the beam between the laser and the reflecting layer. In this case, the mask is configured in such a way that it has congruently in relation to the opaque regions of the reflecting layer regions that are impenetrable for the laser beam and protect the opaque regions of the reflecting layer lying thereunder from the laser beam. Furthermore, a lens arrangement or a lens array may be used as a mask over the reflecting layer, the laser beam being focused by means of the lenses on specific points of the reflecting layer and influencing the path of the laser beam on the reflecting layer.

An optical scanning of the opaque regions of the reflecting layer serves for positioning the impenetrable regions, or regions deflecting the laser beam, of the mask as accurately as possible over the opaque regions of the reflecting layer.

For such methods that exclude the opaque regions of the reflecting layer, both materials with low absorption and materials with high absorption can be used for forming the at least one reflecting layer. It has in this case proven successful to form the at least one reflecting layer as a metal layer, in particular from silver, gold, aluminum, nickel, copper, chromium, etc.

It is particularly preferred if the opaque regions of the at least one reflecting layer, seen perpendicularly to the plane of the at least one reflecting layer, are formed as filigree lines with a width in the range from 0.5 to 1000 μm. Such thin, opaque lines are particularly difficult to forge and can be damaged particularly easily by laser irradiation, so that a high degree of protection against falsification or alteration is achieved for the security document.

It is particularly preferred in this case if the filigree, opaque lines are arranged such that they are adjacent the at least one transparent region. In the transparent region, a laser marking is in this case preferably visible, in particular along with regions of the laser-markable layer that are unmarked, consequently differently colored.

It has proven successful if the at least one reflecting layer is arranged on or in a transparent film body and the film body, including the at least one reflecting layer, is arranged such that it overlaps with the at least one laser-markable layer. As a result, the forming of the at least one reflecting layer cannot take place directly on the laser-markable layer and, furthermore, may include method steps that could impair the laser-markable layer.

In this case, the film body may be applied as a transfer layer of a transfer film or as a laminating film such that it overlaps with the at least one laser-markable layer. A transfer layer may also be applied to a transparent protective layer transmissive to laser radiation and be laminated together with it onto the at least one laser-markable layer. This has the advantage that the at least one reflecting layer can be arranged under the protective layer, protected from mechanical and/or chemical attack. For example, the transfer layer of the transfer film may be stamped onto a banknote by means of stamping.

It has proven successful if the film body is adhesively attached or laminated onto the at least one laser-markable layer. The film body may include further security elements, such as for example luminescent substances, photochromic substances, interference pigments or liquid-crystal pigments, etc.

To form the at least one transparent region, the at least one reflecting layer is preferably formed with a smaller thickness at these points than in the opaque regions, or the at least one reflecting layer is provided with an opening. So, either the at least one reflecting layer may be present in a transparent region with such a small thickness that it is transparent and is not visible, or is scarcely visible, for a viewer. Particularly suitable here are methods for producing such a reflecting layer in which first regions with a diffractive relief structure are stamped into a transparent layer and subsequently the planar second regions and the first regions, provided with the relief structure, of the transparent layer are sputtered with material for forming the reflecting layer, with a constant area density with respect to the plane of the transparent layer. The material for forming the reflecting layer is sputtered on in a thickness such that, on account of the relief structure, in the first regions an at least largely transparent reflecting layer is formed on the surface of the transparent layer, while an opaque reflecting layer forms in the planar second regions.

As an alternative to this, the at least one reflecting layer may be entirely interrupted in a transparent region, so that no material of the reflecting layer is present there. This is usually achieved by partial forming of the reflecting layer by means of masks or partial removal of the reflecting layer, for example by etching of the reflecting layer.

Furthermore, it has proven to be advantageous if the opaque regions of the reflecting layer are formed with at least two different layer thicknesses. This allows the outcome of the laser treatment to be additionally varied.

It has proven successful if the at least one transparent region is merely partially filled with the laser marking, so that unmarked regions of the laser-markable layer remain visible within the at least one transparent region.

It is of advantage if the at least one laser beam for generating the laser marking impinges perpendicularly on the plane of the security document.

However, it may also be of advantage if, at the edge of the at least one transparent region, the at least one laser beam for generating the laser marking is directed obliquely in relation to the plane of the security document and the laser marking is continued under the opaque regions, at least over a short region. For this purpose, it may be necessary to provide a transparent spacing layer transmissive to the laser beam to be provided between the laser-markable layer and the reflecting layer.

Preferably, a color change, a blackening or a bleaching takes place in the at least one laser-markable layer in the region of the laser marking. As a result, color markings, color images, black-and-white-markings, gray-scale images or combinations thereof are generated. The laser marking is in this case generated in particular permanently or irreversibly in the laser-markable layer and cannot be erased again by subsequent UV irradiation or otherwise.

To generate color images, it has proven successful if at least three laser-markable layers arranged one on top of the other are provided, in particular in the colors cyan, magenta and yellow. Alternatively, the different colorants may also be admixed with a single laser-markable layer, which before the laser treatment is in the combined color of all the laser-sensitive colorants.

Color layers containing bleachable pigments are used with preference as laser-markable layers. So, yellow pigments are preferably bleached by means of blue laser light, cyan-colored pigments are preferably bleached with red laser light and magenta-colored pigments are preferably bleached with green laser light. Black laser-markable layers preferably contain carbon, while blackenable laser-markable layers contain in particular carbon compounds that can be broken down by means of laser radiation. Alternatively or in addition, laser-markable materials which for example show a significant, irreversible color change under laser irradiation may be contained in the laser-markable layer. If multiple laser-markable layers are used one on top of the other or a laser-markable layer containing a mixture of different colorants is used, it is possible by means of successive laser treatment of the individual laser-markable layers or individual points of the laser-markable layer containing a mixture of different colorants to generate full-color images with a natural color profile, for example a photo of the owner of the security document to be marked, by subtractive or additive color mixing.

The at least one laser-markable layer may be arranged on a carrier substrate of paper, PE, PC, PET, PVC or Teslin®. In a way similar to the reflecting layer, the at least one laser-markable layer may also be laminated onto the carrier substrate or adhesively attached with the aid of an adhesive layer as a laminating film or transfer layer of a transfer film.

Furthermore, the security document may comprise additional layers, such as protective layers, printed layers, etc., which are arranged on the rear side of the carrier substrate, between the carrier substrate and the laser-markable layer, between the laser-markable layer and the reflecting layer and also on the reflecting layer.

It has proven successful if a background layer, which absorbs the at least one laser beam for generating the laser marking, is arranged at least in certain regions between the at least one laser-markable layer and the carrier substrate. This is of advantage in particular for sensitive carrier substrates of paper.

Preferably, the at least one laser-markable layer is arranged on the carrier substrate in the form of a pattern. This may take place by direct application of the layer material, for example by means of printing or by a transfer method in which the laser-markable layer is formed on a carrier, for example a transfer film, and is transferred onto the carrier substrate in a solid state, while the carrier is pulled off again. This makes an optically particularly attractive design of the security document possible.

Furthermore, the at least one laser-markable layer itself may be provided by a laser-markable carrier substrate of paper, PVC, PC, Teslin® or a carrier substance doped with laser-markable substances.

It has proven successful if at least two reflecting layers with opaque regions of different colors are arranged on the at least one laser-markable layer. In particular, the combination of silver-colored and gold-colored opaque metal regions produces a particularly high-quality appearance.

It has proven to be advantageous if the transparent film body or the security document has in addition to the least one reflecting layer a transparent or semi-transparent color layer and/or a transparent or semi-transparent dielectric layer and/or a transparent or semi-transparent optically variable layer. This may also be laser-markable, it being possible for a laser marking to take place with the same laser beam that is also used for marking the laser-markable layer. Simultaneous laser marking with the laser-markable layer is in this case preferred. The transparent color layer and/or the transparent HRI layer and/or the transparent optically variable layer is preferably arranged on the side of the reflecting layer that is opposite from the laser-markable layer.

An optically variable layer preferably comprises a diffractive structure and/or a holographic structure, in particular a hologram or Kinegram®, and/or a liquid-crystal material and/or a thin-film multi-layer system with a viewing-angle-dependent interference effect, which may also comprise transparent metallic thin films, and/or a photochromic substance and/or a luminescent substance. The transmissivity of the transparent regions of the reflecting layer to the at least one laser beam is preferably not impaired, or only insignificantly, by the additional transparent or semi-transparent layers contained in the transparent film body or security document.

It has proven successful if, from the perspective of a viewer, at least opaque regions of the at least one reflecting layer are arranged at least partly under the optically variable layer, in particular under a hologram or Kinegram®, and/or a thin-film multi-layer system. In particular, it is of advantage if the optically variable layer extends over opaque regions and/or over the at least one transparent region. In this case, the optically variable effect of the optically variable layer may be evident only over and in register with opaque regions or else only over and in register with the at least one transparent region. It is preferred here to arrange a diffractive or holographic structure exactly in register with the respective opaque or transparent regions. The optically variable effect of the optically variable layer is in this case intensified either by the reflective layer itself or, if the latter has an opening, for example by an additional transparent dielectric HRI layer (High Refraction Index).

Generally, an at least substantially transparent dielectric HRI layer, which does not disturb, or scarcely disturbs, a laser marking of the laser-markable layer and is also not impaired, or not substantially impaired, by the laser radiation, may be provided under and/or over the reflecting layer. Such an HRI layer may be arranged in register with the opaque regions and/or the transparent regions of the reflecting layer and, as a result, provide additional, attractive optical effects. Known materials for HRI layers are, for example, ZnS or $TiO_2$.

The transparent color layer and/or the transparent HRI layer and/or the transparent optically variable layer may be arranged on the side of the reflecting layer that is opposite from the laser-markable layer.

The color layer, the HRI layer or the optically variable layer may be applied directly to the reflecting layer or be applied to a transparent film which possibly exhibits diffractive relief structures, at least in certain regions or in the form of a pattern, the film subsequently being arranged over or under the reflecting layer, for example by adhesive attachment, lamination, hot stamping, etc.

Furthermore, a microlens array may be combined with the reflecting layer, the laser beam being focused by means of a microlens and the outcome of the laser irradiation and the result visible thereafter being additionally influenced.

It has proven successful if the at least one laser beam for generating the laser marking is generated by a neodymium-YAG laser radiation source. Other laser radiation sources may also be used, however. Pulsed, frequency-multiplied solid-state lasers, optical parametric oscillators (OPOs) and pulsed UV lasers (such as excimer lasers) are suitable. In the laser treatment, energy densities of preferably between 0.05 and 0.5 $J/cm^2$ with a pulse duration of 5 to 20 ns may be used.

It is pointed out that the invention does not exclude the possibility of also quite deliberately altering optical regions of the reflecting layer or regions of an HRI layer or optically variable layer in combination, at least in certain regions, with the laser beam, in order for example to perform additional personalization. This may result in not only opaque regions of the reflecting layer which, according to the invention, have not been altered, or scarcely altered, by the laser irradiation of the laser-markable layer arranged thereunder but also opaque regions which have been visibly altered by means of the laser beam, for example by blackening, dulling or ablation, as is already sufficiently well-known from DE 44 10 431 A1. In the case of a thin-film multi-layer system, layers of the thin-film stack can be deliberately altered by means of the laser irradiation, in order to alter or remove the viewing-angle-dependent interference effect. This provides a multitude of possibilities for making a security document forgery-proof, and nevertheless optically attractive, by means of the laser irradiation.

In this connection, it has also proven successful to make the thickness of the reflecting layer in the opaque regions not uniform but with differing layer thicknesses, in order to achieve the effect that the opaque regions of the reflecting layer can be differently influenced by the laser radiation.

BRIEF DESCRIPTION OF THE DRAWINGS

The invention is intended to be explained by way of example by FIGS. 1 to 3, in which.

DETAILED DESCRIPTION OF THE INVENTION

Figure 1:
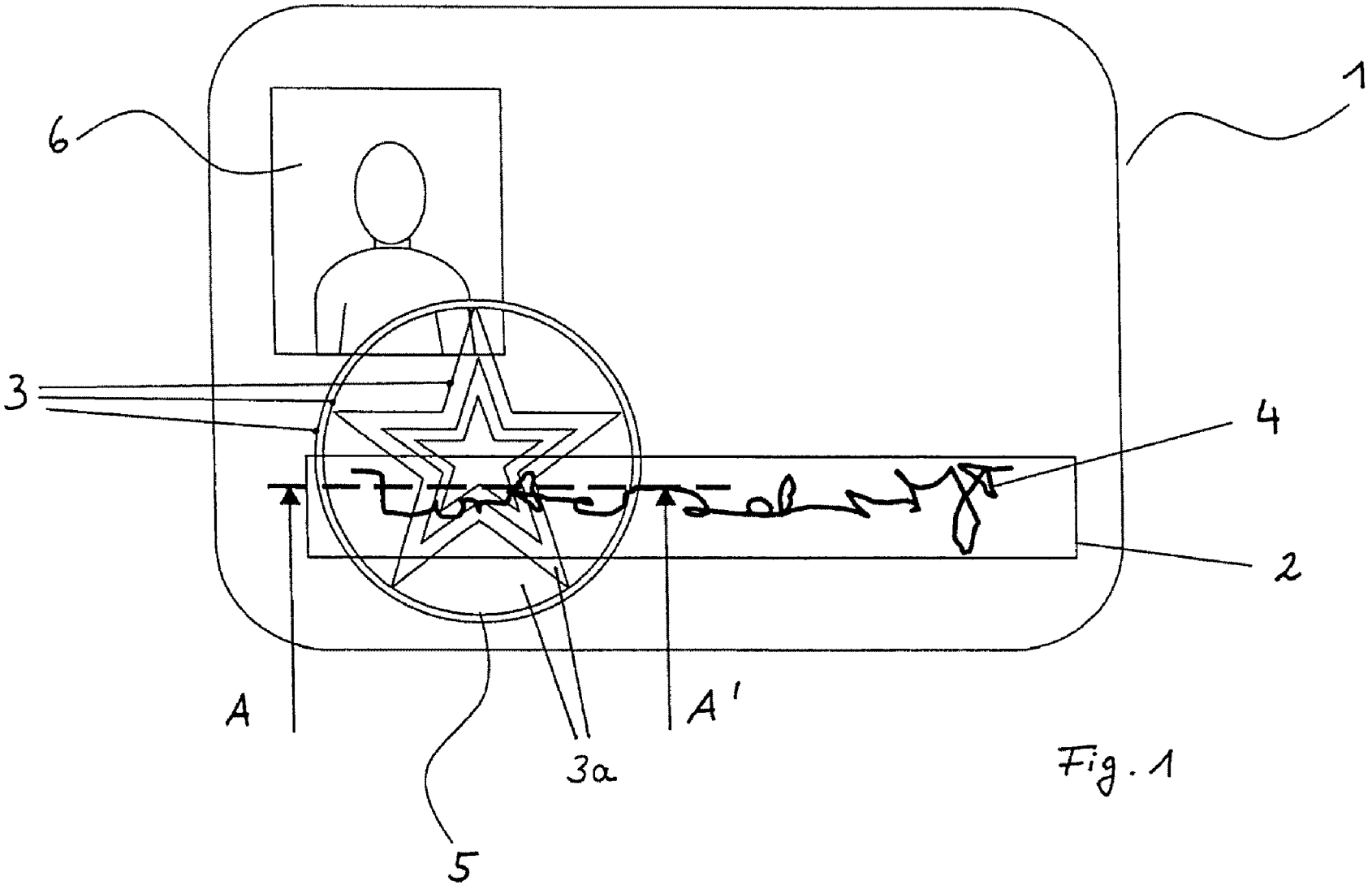
FIG. 1 shows a security document in the form of an identity card.

FIG. 1 shows a security document 1 in the form of an identity card in plan view. The security document 1 comprises a laser-markable layer 2 in the form of a signature area, printed on in certain regions, and a circular film body 5.

To form the laser-markable layer 2, a color coating with the following composition was used:

| | |
|---|---|
| methyl ethyl ketone | 34.0 parts |
| toluene | 26.0 parts |
| ethyl acetate | 13.0 parts |
| cellulose nitrate (low-viscosity, 65% in alcohol) | 20.0 parts |
| linear polyurethane (flow point > 200° C.) | 3.5 parts |
| high-molecular-weight dispersing agent (40%, amine value 20) | 2.0 parts |
| Pigment Blue 15:4 | 0.5 parts |
| Pigment Red 57:1 | 0.5 parts |
| Pigment Yellow 155 | 0.5 parts |

The film body 5 comprises as the reflecting layer a metal layer, the opaque regions 3 of which are linearly formed with a width of in each case 50 μm and present two concentric circles containing three concentric stars. Between the opaque metal lines 3 there are transparent regions 3*a* transmissive to the laser beam, in which the metal layer has openings affording a view of regions lying thereunder of the laser-markable layer 2, a photo 6 of the card owner and also a carrier substrate 7 (see FIGS. 2*a* to 2*c*). A laser marking 4 in the form of a signature of the card owner has been introduced into the laser-markable layer 2 by laser radiation. The laser marking 4 gives the viewer the impression that it was already present in the laser-markable layer 2 before the film element 5 was applied.

Figure 2A:
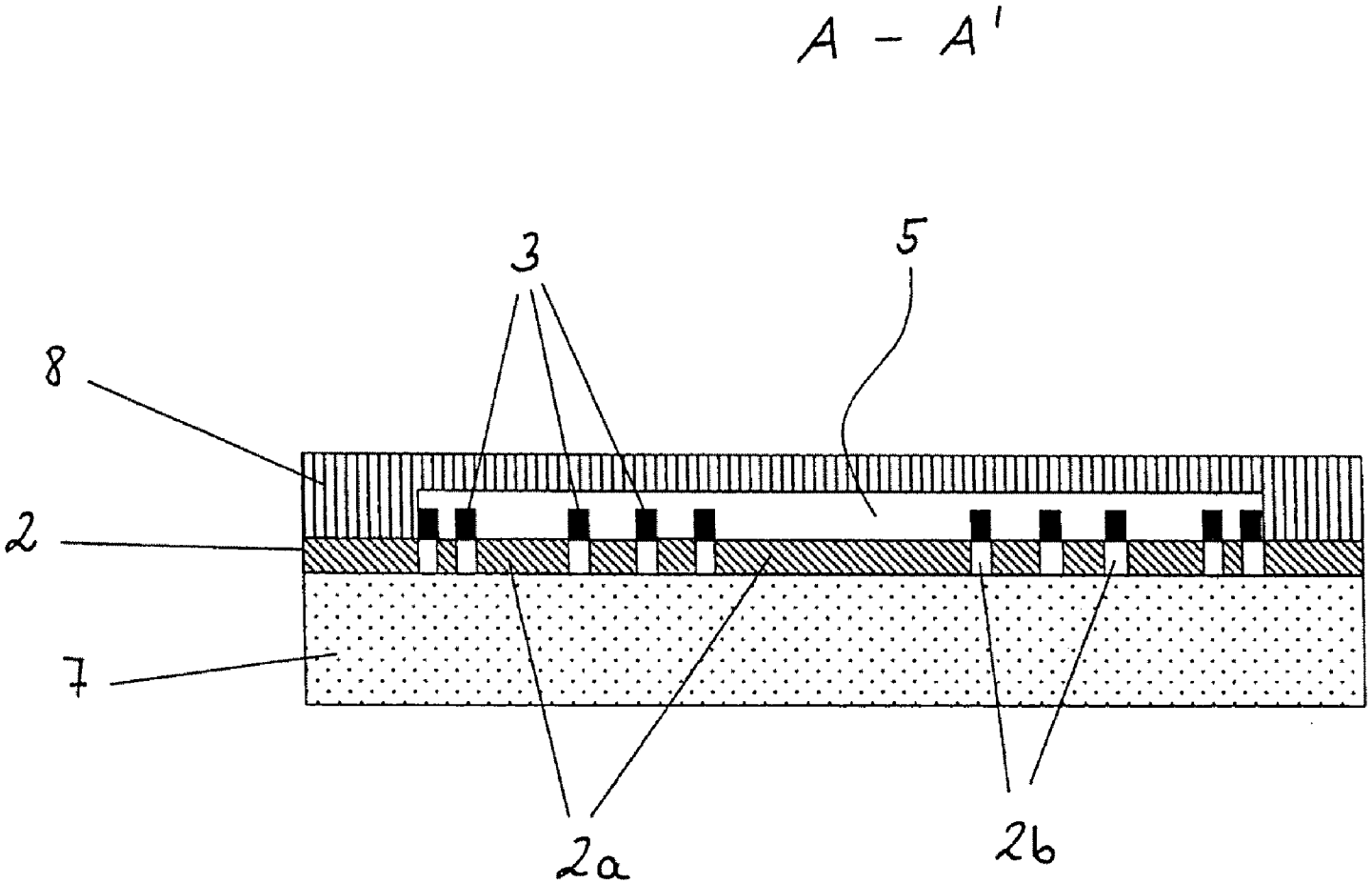
FIG. 2*a* shows a simplified sectional representation in the region A-A' through a security document according to FIG. 1.

FIG. 2*a* shows a simplified sectional representation in the region A-A' through the security element 1 according to FIG. 1. In the simplified representation of FIG. 2*a*, it is assumed that the sectional line exactly follows the path of the laser marking 4, and consequently intersects the opaque metal lines 3 of the concentric circles and stars and also the transparent regions 3*a* exactly in the region of the laser marking 4. Recognizable on a carrier substrate 7 is the laser-markable layer 2, which covers the film body 5 containing the metal layer. The film body 5 comprises the filigree, linear opaque metal regions 3. The upper side of the security element 1, represented here in the form of a detail, is laminated over with a transparent protective film 8 transmissive to the laser beam, so that the film element 5 is embedded in a protected manner between the protective film 8 and the carrier substrate 7. The laser beam for generating the laser marking 4 (see FIG. 1) was directed perpendicularly onto the plane of the security element 1 and the laser marking 4 generated in the laser-markable layer 2. To protect the carrier substrate 7, a background layer—not shown here—which may be formed by a color coating with the following composition, may be arranged between the laser-markable layer 2 and the carrier substrate 7:

| | |
|---|---|
| methyl ethyl ketone | 40.0 parts |
| toluene | 22.0 parts |
| ethylene-vinyl acetate terpolymer (flow point = 60° C.) | 2.5 parts |
| polyvinyl chloride (glass transition temperature: 89° C.) | 5.5 parts |
| polyvinyl chloride (glass transition temperature: 40° C.) | 3.0 parts |
| dispersing agent (50%, acid value 51) | 1.0 parts |
| titanium dioxide ($d = 3.8\text{-}4.2\ g/cm^3$) | 26.0 parts |

If the laser beam is passed over the opaque metal regions with unchanged power, the opaque metal regions 3 of the metal layer are formed from silver and with a thickness of 10 μm.

If, alternatively, a positional detection of the opaque metal regions 3 is carried out, for example by means of a camera which detects the position of some or all of the opaque metal regions 3 and generates corresponding data, a control of the laser beam takes place on the basis of the generated data in such a way that the opaque metal regions 3 are omitted from the laser treatment, or are impinged with lower laser power or the laser beam is passed over the opaque metal regions 3 more quickly than over the regions to be marked of the laser-markable layer 2. In this case, the opaque metal regions 3 of the metal layer are formed with a thickness of 30 nm and gold is used as the material for the metal layer.

In the regions 2*b* under the opaque metal regions 3, the laser-markable layer 2 is in any event unaltered in its form, since the laser beam for generating the laser marking 4 (see FIG. 1) is not active under the opaque metal regions 3. Apart from the opaque metal regions 3, the at least one laser beam goes onto the laser-markable layer 2, which is consequently altered in its color in the regions 2*a* and, seen from the perspective of the viewer perpendicularly to the plane of the metal layer, exhibits a laser marking 4, which is formed as a signature.

The laser marking 4 (or the laser-marked regions 2*a*) in FIG. 1 appears to the viewer as a continuous signature in the laser-markable layer 2 otherwise unaltered in its color, and independently of the form of the opaque metal regions 3 of the metal layer. In fact, however, the signature is interrupted in the region under each and every opaque metal line.

From economic aspects, usually only regions of a laser-markable layer that are of a small surface area are laser-treated. However, regions of a large surface area could also be laser-marked. So, in FIG. 1, the background region which lies behind the signature could be formed as a laser marking and the signature could be in the color of the laser-markable layer that is not marked by the laser, and is therefore not altered in its color. In this case, seen perpendicularly to the plane of the metal layer, there would be an interruption of the laser marking under the opaque metal regions in the background region—not visually perceptible for a viewer—while the signature would be continuously present, even under the opaque metal regions.

Figure 2B:
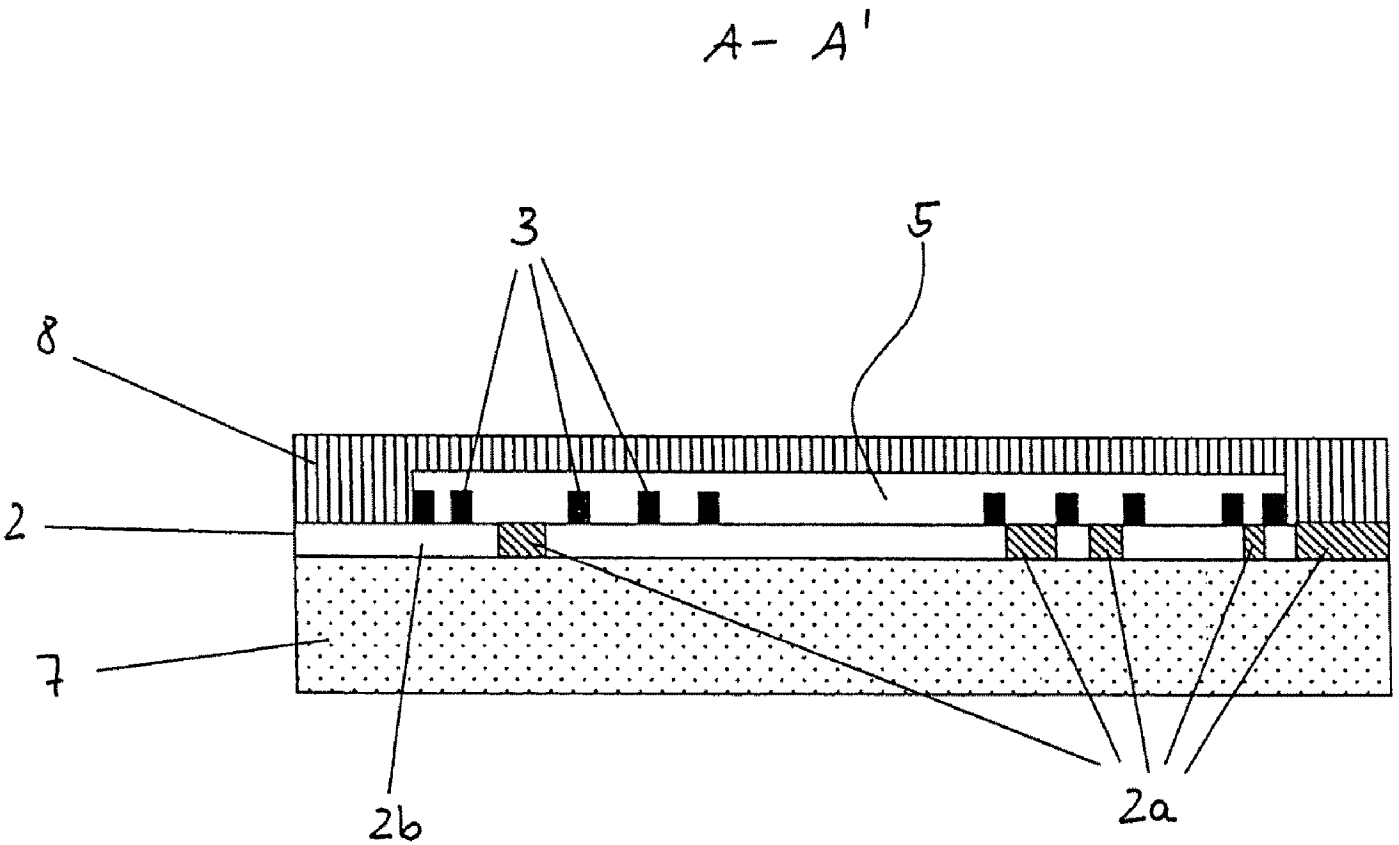
FIG. 2*b* shows an actual sectional representation in the region A-A' through a security document according to FIG. 1.

By contrast with FIG. 2*a*, FIG. 2*b* shows the actual sectional representation in the region A-A' through the security element 1 according to FIG. 1.

Figure 2C:
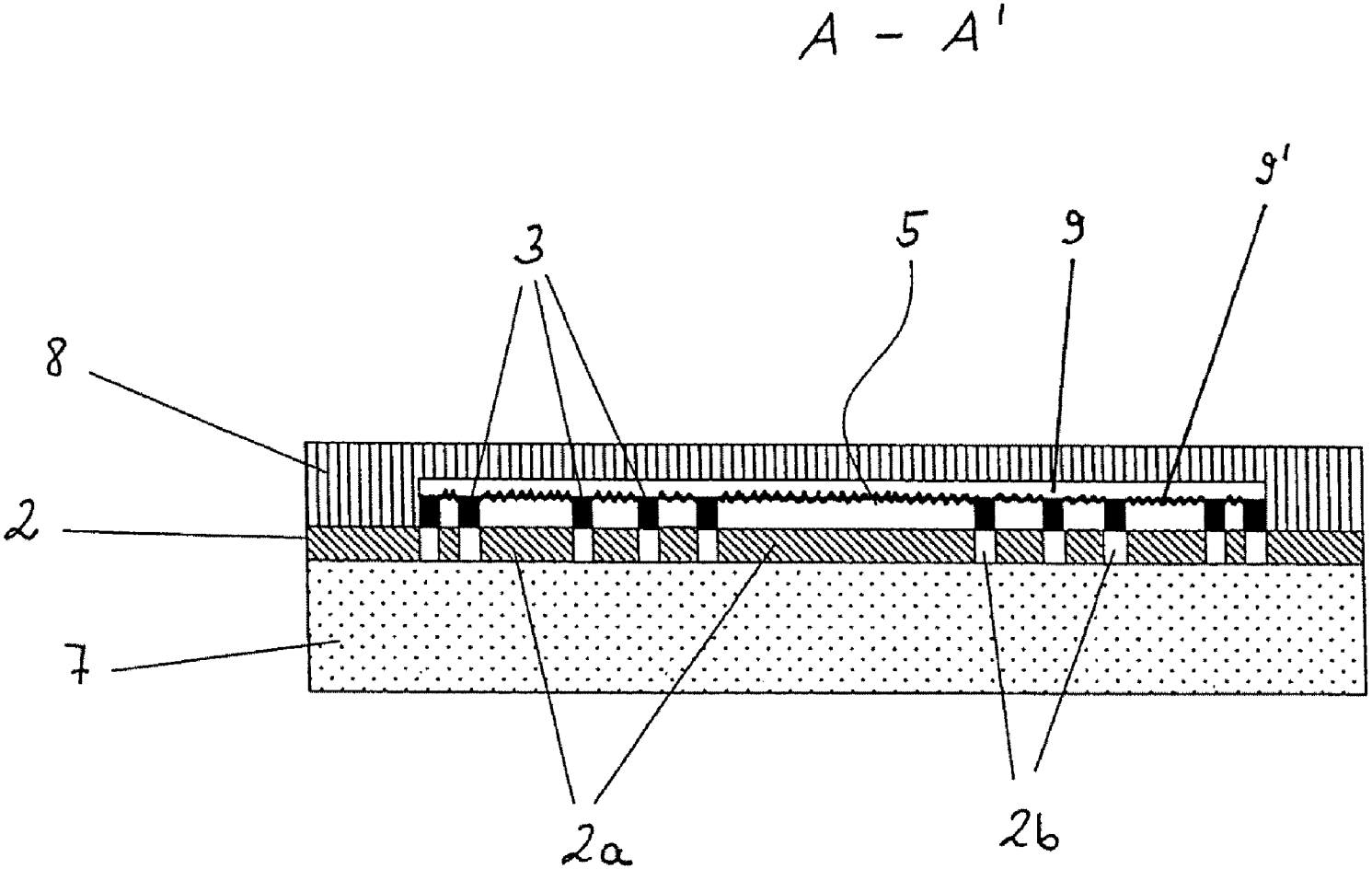
FIG. 2*c* shows a further simplified sectional representation in the region A-A' through a security document according to FIG. 1 containing an optically variable layer with a diffractive structure.

FIG. 2*c* shows a further simplified sectional representation in the region A-A' through the security element 1 according to FIG. 1, which here, however, comprises an optically variable layer 9 with a diffractive relief structure 9'. In the simplified representation of FIG. 2*b*, it is once again assumed that the sectional line exactly follows the path of the laser marking 4, and consequently intersects the opaque metal lines 3 of the concentric circles and stars and also the transparent regions 3*a* exactly in the region of the laser marking 4. Recognizable on a carrier substrate 7 is the laser-markable layer 2, which covers the film body 5 containing the metal layer. The film body 5 comprises the filigree, linear opaque metal regions 3. The upper side of the security element 1, represented here in the form of a detail, is laminated over with a transparent protective film transmissive to the laser beam, so that the film element 5 is embedded in a protected manner between the protective film 8 and the carrier substrate 7. The diffractive relief structure 9' is arranged in register with the transparent regions in the metal layer, a transparent HRI layer of ZnS (not separately represented here) being arranged on the side of the optically variable layer 9 that has the diffractive relief structure 9'.

Figure 3:
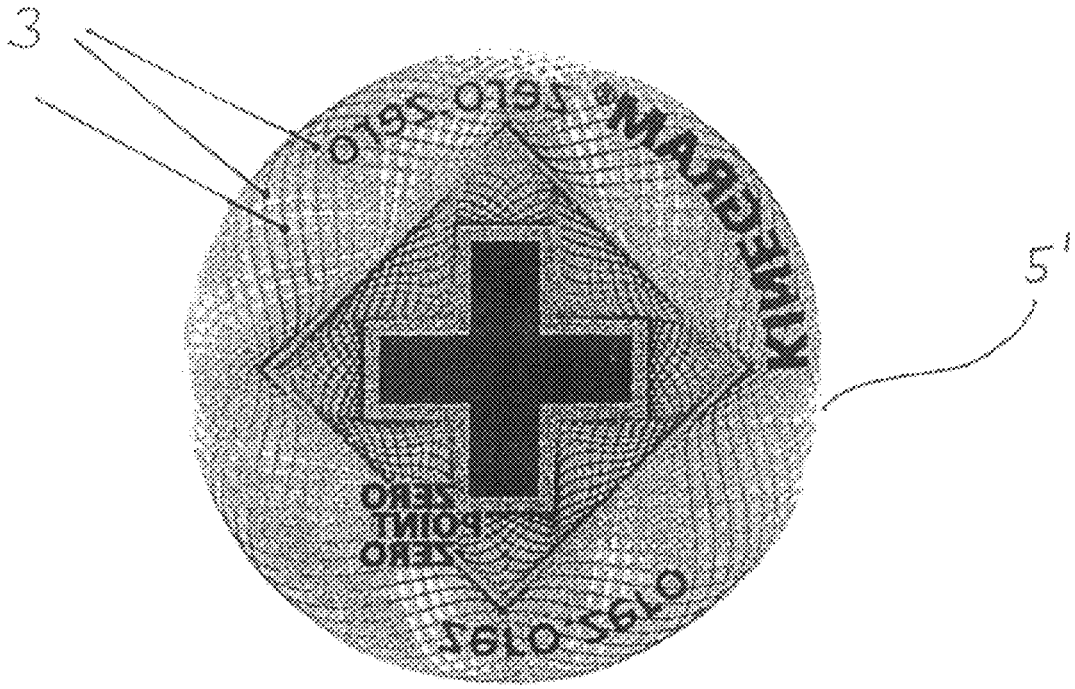
FIG. 3 shows a transparent film body with a reflecting metal layer comprising filigree metal lines as opaque regions.

FIG. 3 shows an approximately 400% magnification of an example of a film element 5' containing filigree opaque metal regions 3 arranged in the form of grid lines and further opaque metal regions (inter alia in the form of a cross), the film elements 5' presenting a Kinegram® and it being possible for said film elements to be arranged over one or more laser-sensitive layers.

Figure 4A:
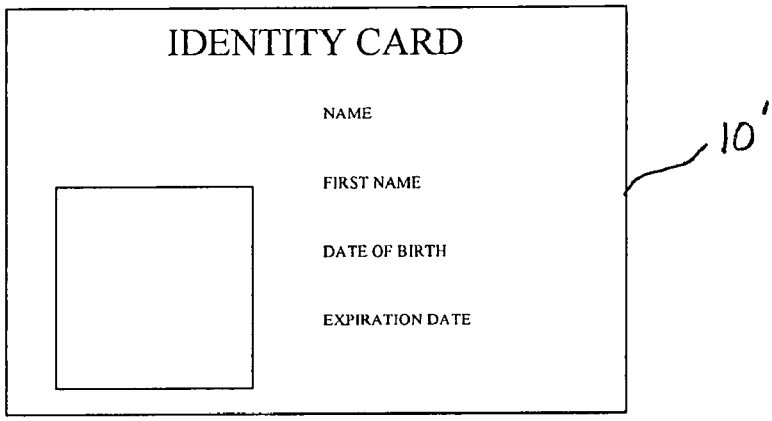
FIGS. 4*a* to 4*c* shows the personalizing of an identity card by means of a laser.

FIG. 4*a* shows in plan view a blank identity card 10' before the laser personalization, that is before the introduction of personal, individual data of an owner of the pass. The blank identity card 10' provides space for an image of the owner of the pass and for the owner's name, first name, date of birth and for a date indicating the period of validity of the pass. At least in these regions of the blank identity card 10' there is a laser-markable layer, in which the data can be recorded.

Figure 4B:
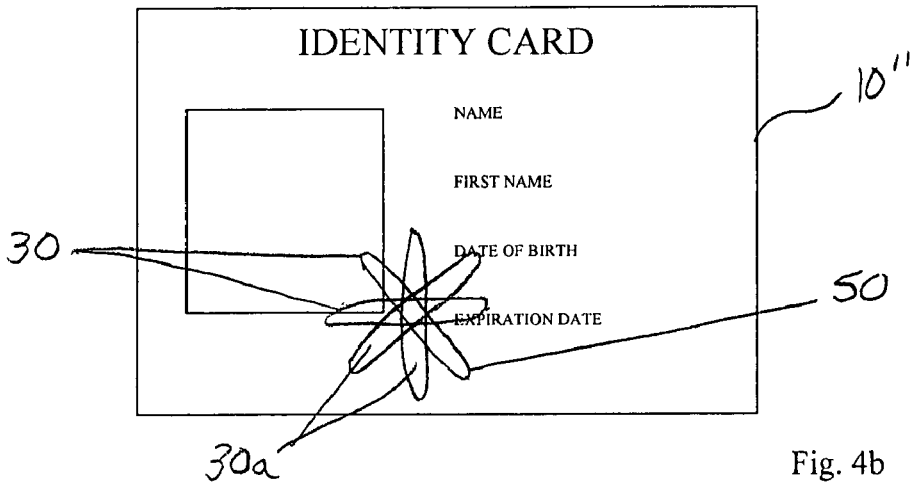

According to FIG. 4*b*, a film element 50 is then transferred to the blank identity card 10' by means of a hot stamping film, the laser-markable regions in which the personal data are to be recorded being partly covered. The film element 50 has a reflecting layer and a metal layer, the opaque regions 30 of which are formed linearly with a width of in each case 55 μm. All the opaque regions 30 together produce a blossom-like formation, made up of nine individual ellipses. The opaque regions 30 are in a region of the film element 50 with a relief structure, which presents a kinematic effect. A so-called Kinegram® is visible. Apart from the opaque regions 30 of the film element 50 there are transparent regions 30*a*, through which the laser-markable regions of the blank identity card 10' lying thereunder can be seen. The identity card 10", coated by means of the film element 50, does not yet comprise any personal data, but merely the film element 50.

Figure 4C:
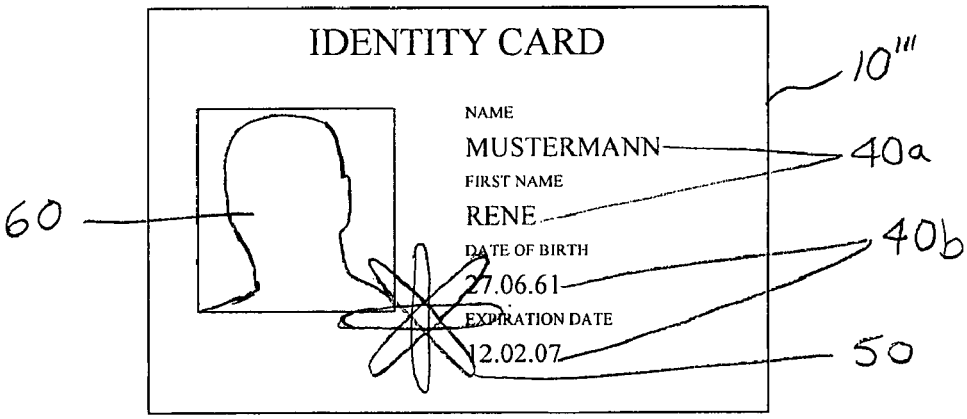

According to FIG. 4*c*, the personal data of an owner of the pass are then introduced into the coated identity card 10" by means of a laser beam. In this case, an image 60 of the owner of the pass which overlaps with the film element 50 is generated. Furthermore, data 40*a*, 40*b* are recorded, the data 40*b* likewise overlapping with the film element 50. The laser personalization in the region of the film element 50 or the opaque regions 30 takes place by the method according to the invention, in that the opaque regions 30 of the metal layer are omitted from the laser irradiation or are excluded from the laser treatment. The impression produced for the finished identity card 10''' is optically as though the laser marking in the form of the data 40*b* or the image 60 were already generated in the blank identity card 10' before the film element 50 was applied. The opaque regions 30 of the metal layer that are adjacent regions with the laser marking are at least optically indistinguishable from opaque regions 30 with no adjacent laser marking. There is consequently no need for the film element 50 to be provided only after introduction of the laser marking.

The invention claimed is:

1. A method of generating a laser marking in a security document by means of at least one laser beam, the security document having at least one laser-markable layer and also at least one reflecting layer which overlaps at least partly with the at least one laser-markable layer, the reflecting layer having at least one transparent region separated by opaque regions, wherein the at least one reflecting layer is formed, at least in an overlapping region in which the at least one reflecting layer and the laser-markable layer overlap, seen perpendicularly to the plane of the reflecting layer, with at least one transparent region surrounded on at least two sides by an opaque region of the at least one reflecting layer, and wherein the at least one reflecting layer is arranged between at least one laser radiation source for the at least one laser beam and the at least one laser-markable layer, and wherein the laser marking is generated in the at least one laser-markable layer such that the laser marking forms visually recognizable alphanumeric characters, or strings of characters, symbols, logos, images, photos, captions, lines, biometric data, or fingerprints through the at least one transparent region, the at least one reflecting layer being retained at least visually largely unaltered, and wherein the at least one transparent region is formed by an opening provided in the reflecting layer, the opening having no material of the reflecting layer present therein.

2. The method as claimed in claim 1, wherein the at least one reflecting layer is formed by a metal layer and/or a colored semiconductor layer.

3. The method as claimed in claim 2, wherein the at least one reflecting layer is formed as a metal layer of silver, gold, aluminum, copper, chromium or nickel.

4. The method as claimed in claim 1, wherein the opaque regions of the at least one reflecting layer, seen perpendicularly to the plane of the reflecting layer, are formed as a pattern and/or a grid and/or an area of parallel and/or wavy lines.

5. The method as claimed in claim 1, wherein the at least one transparent region is surrounded by opaque regions on all sides.

6. The method as claimed in claim 1, wherein a mask which, seen perpendicularly to the reflecting layer, is formed at least over the opaque regions of the reflecting layer with regions that are impenetrable for the laser beam is arranged in the path of the beam between the laser radiation source and the reflecting layer.

7. The method as claimed in claim 6, wherein a positional detection of at least parts of the opaque region of the at least one reflecting layer or the impenetrable regions of the mask is carried out, and wherein the at least one laser beam for generating the laser marking is controlled on the basis of data determined from the positional detection in such a way that the at least one laser beam for generating the laser marking does not at any point impinge on the opaque regions of the at least one reflecting layer or on the impenetrable regions of the mask, wherein that a lowering of the power of the laser beam for generating the laser marking takes place in the region of the opaque regions of the at least one reflecting layer or the impenetrable regions of the mask.

8. The method as claimed in claim 7, wherein the positional detection is carried out optically.

9. The method as claimed in claim 7, wherein the at least one reflecting layer is formed with at least one optically detectable positional marking and a position of the positional marking is determined or wherein, independently of the at least one reflecting layer, at least one optically detectable positional marking is formed on the security document and a position of the positional marking is determined.

10. The method as claimed in claim 9, wherein the at least one reflecting layer is formed with at least three optically detectable positional markings and the position of the at least three positional markings is determined to detect a distortion of the at least one reflecting layer that may have occurred when the at least one reflecting layer was applied to the at least one laser-markable layer.

11. The method as claimed in claim 1, wherein the at least one reflecting layer has in the opaque regions a thickness in the range from 0.2 to 150 μm.

12. The method as claimed in claim 11, wherein the at least one laser beam for generating the laser marking is passed over the opaque regions of the at least one reflecting layer and the at least one transparent region.

13. The method as claimed in claim 1, wherein at least one detection laser beam is coupled into the at least one laser beam for generating the laser marking or is directed parallel to the at least one laser beam, and wherein a lowering of the power of the at least one laser beam for generating the laser marking, or switching off of the same, takes place when the at least one detection laser beam detects the presence of opaque regions of the at least one reflecting layer.

14. The method as claimed in claim 1, wherein the opaque regions of the at least one reflecting layer, seen perpendicularly to the plane of the at least one reflecting layer, are formed as filigree lines with a width in the range from 0.5 to 1000 μm.

15. The method as claimed in claim 14, wherein the filigree lines are arranged such that they are adjacent the at least one transparent region.

16. The method as claimed in claim 1, wherein the at least one reflecting layer is arranged on or in a transparent film body and wherein the film body, including the at least one reflecting layer, is arranged such that it overlaps with the at least one laser-markable layer.

17. The method as claimed in claim 16, wherein the film body is applied as a transfer layer of a transfer film or as a laminating film such that it overlaps with the at least one laser-markable layer.

18. The method as claimed in claim 16, wherein the film body is adhesively attached or laminated such that it overlaps with at least one laser-markable layer.

19. The method as claimed in claim 16, wherein the transparent film body is formed with a transparent color layer and/or a transparent HRI layer and/or a transparent optically variable layer, which possibly can be marked with the laser beam.

20. The method as claimed in claim 19, wherein the transparent color layer and/or the transparent HRI layer and/or the transparent optically variable layer is arranged on the side of the reflecting layer that is opposite from the laser-markable layer.

21. The method as claimed in claim 19, wherein the optically variable layer is formed such that it comprises a diffractive structure and/or a holographic structure and/or a liquid-crystal material and/or a thin-film multi-layer system with a viewing-angle-dependent interference effect and/or a photochromic substance and/or a thermochromic substance and/or a luminescent substance.

22. The method as claimed in claim 1, wherein the at least one transparent region is merely partially filled with the laser marking, so that unmarked regions of the laser-markable layer remain visible within the at least one transparent region.

23. The method as claimed in claim 1, wherein the at least one laser beam for generating the laser marking impinges perpendicularly on the plane of the security document.

24. The method as claimed in claim 23, wherein, at the edge of the at least one transparent region, the at least one laser beam for generating the laser marking is directed obliquely in relation to the plane of the security document and the laser marking is continued under the opaque regions.

25. The method as claimed in claim 1, wherein a color change, a blackening or a bleaching takes place in the at least one laser-markable layer in the region of the laser marking.

26. The method as claimed in claim 1, wherein at least three laser-markable layers arranged one on top of the other are provided.

27. The method as claimed in claim 1, wherein the at least one laser-markable layer is arranged on a carrier substrate of paper, PE, PC, PET, PVC or a microporous polyolefin sheet material.

28. The method as claimed in claim 27, wherein a background layer, which absorbs the at least one laser beam for generating the laser marking, is arranged at least in certain regions between the at least one laser-markable layer and the carrier substrate.

29. The method as claimed in claim 27, wherein the at least one laser-markable layer is arranged on the carrier substrate in the form of a pattern.

30. The method as claimed in claim 1, wherein the at least two reflecting layers with opaque regions of different colors are arranged such that they overlap with the at least one laser-markable layer.

31. The method as claimed in claim 1, wherein the at least one laser beam for generating the laser marking is generated by a neodymium-YAG laser source.

32. The method as claimed in claim 1, wherein the at least one laser beam for generating the laser marking is passed over the opaque regions of the at least one reflecting layer and the at least one transparent region.

33. A security document comprising at least one laser-markable layer and also at least one reflecting layer which overlaps at least partly with the at least one laser-markable layer, the reflecting layer having a plurality of transparent regions separated by opaque regions, the at least one reflecting layer being formed, at least in an overlapping region in which the at least one reflecting layer and the laser-markable layer overlap, seen perpendicularly to the plane of the reflecting layer, with at least one transparent region surrounded on at least two sides by an opaque region of the at least one reflecting layer, wherein a contiguous laser marking in the laser-markable layer, spanning at least two transparent regions, forms visually recognizable alphanumeric characters, or strings of characters, symbols, logos, images, photos, captions, lines, biometric data, or fingerprints for a viewer in at least two adjacent transparent regions, the laser marking being formed independently of the configuration of the transparent regions in the reflecting layer, and wherein the laser marking in the laser-markable layer is interrupted under the opaque regions such that this is not visually recognizable for the viewer, and wherein the at least one transparent region is formed by an opening provided in the reflecting layer, the opening having no material of the reflecting layer present therein.

34. The security document as claimed in claim 33, wherein the at least one reflecting layer is formed by a metal layer and/or a semiconductor layer.

35. The security document as claimed in claim 33, wherein the opaque regions of the at least one reflecting layer, seen perpendicularly to the plane of the reflecting layer, are formed as a pattern and/or a grid and/or an area of parallel and/or wavy line.

36. The security document as claimed in claim 33, wherein the opaque regions of the at least one reflecting layer, seen perpendicularly to the plane of the at least one reflecting layer, are formed as filigree lines with a width in the range from 0.5 to 1000 μm.

37. The security document as claimed in claim 33, wherein the filigree lines are arranged such that they are adjacent the at least one transparent region.

38. The security document as claimed in claim 33, wherein the at least one reflecting layer is arranged on or in a film body and wherein the film body, including the at least one reflecting layer, is arranged such that it overlaps with the at least one laser-markable layer.

39. The security document as claimed in claim 38, wherein the transparent film body has a transparent color layer and/or a transparent HRI layer and/or a transparent optically variable layer, which possibly is laser-marked.

40. The security document as claimed in claim 39, wherein the transparent color layer and/or the transparent HRI layer and/or the transparent optically variable layer is arranged on the side of the reflecting layer that is opposite from the laser-markable layer.

41. The security document as claimed in claim 39, wherein the optically variable layer comprises a diffractive structure and/or a holographic structure and/or a liquid-crystal material and/or a thin-film multi-layer system with a viewing-angle-dependent interference effect and/or a photochromic substance and/or a thermochromic substance and/or a luminescent substance.

42. The security document as claimed in claim 39, wherein, from the perspective of a viewer, at least opaque regions of the reflecting layer are arranged at least partly under the optically variable layer and/or under the HRI layer.

43. The security document as claimed in claim 39, wherein the optically variable layer extends over opaque regions and/or over the at least one transparent region.

44. The security document as claimed in claim 33, wherein the at least one transparent region is merely partially filled with the laser marking, so that unmarked regions of the laser-markable layer remain visible within the at least one transparent region.

45. The security document as claimed in claim 33, wherein at least three laser-markable layers arranged one on top of the other are present.

46. The security document as claimed in claim 33, wherein the at least one laser-markable layer is arranged on a carrier substrate of paper, PE, PC, PET, PVC or a microporous polyolefin sheet material.

47. The security document as claimed in claim 46, wherein a background layer, which absorbs the at least one laser beam for generating the laser marking, is arranged at least in certain regions between the at least one laser-markable layer and the carrier substrate.

48. The security document as claimed in claim 46, wherein the at least one laser-markable layer is arranged on the carrier substrate in the form of a pattern.

49. The security document as claimed in claim 33, wherein at least two reflecting layers with opaque regions different colors are arranged such that they overlap with the at least one laser-markable layer.

50. The security document as claimed in claim 33, wherein the opaque regions of the at least one reflecting layer are formed with at least two different layer thicknesses.

51. A method of generating a laser marking in a security document comprising the steps of:

providing at least one laser-markable layer on a security document;

providing at least one reflecting layer on the security document such that the reflecting layer at least partly overlaps with the at least one laser-markable layer, the reflecting layer having at least one transparent region separated by opaque regions, the at least one transparent region and the opaque regions being provided in an overlapping region in which the at least one reflecting layer and the laser-markable layer overlap, wherein the at least one transparent region is surrounded on at least two sides by an opaque region of the at least one reflecting layer;

laser marking the laser-markable layer with at least one laser beam provided by a laser radiation source, the at least one reflecting layer being arranged between the laser radiation source and the at least one laser-markable layer such that the laser marking forms visually recognizable alphanumeric characters, or strings of characters, symbols, logos, images, photos, captions, lines, biometric data, or fingerprints through the at least one transparent region, wherein the at least one reflecting layer is retained at least visually largely unaltered, and wherein the at least one transparent region is only partially filled with the laser marking, so that unmarked regions of the laser-markable layer remain visible within the at least one transparent region.

52. A security document comprising;

at least one laser-markable layer;

at least one reflecting layer at least partly overlapping with the at least one laser-markable layer, the reflecting layer having a plurality of transparent regions separated by opaque regions, at least one transparent region being surrounded on at least two sides by an opaque region of the at least one reflecting layer, the at least one transparent region being provided in an overlapping region in which the at least one reflecting layer and the laser-markable layer overlap, seen perpendicularly to the plane of the reflecting layer; and a contiguous laser marking disposed in the laser-markable layer, the laser marking spanning at least two transparent regions and forming visually recognizable alphanumeric characters, or strings of characters, symbols, logos, images, photos, captions, lines, biometric data, or fingerprints visible to a viewer in at least two adjacent transparent regions, the laser marking being formed independently of the configuration of the transparent regions in the reflecting layer, wherein the laser marking in the laser-markable layer is interrupted under the opaque regions such that this is not visually recognizable for the viewer, and wherein the at least one transparent region is only partially filled with the laser marking, so that unmarked regions of the laser-markable layer remain visible within the at least one transparent region.

53. A method of generating a laser marking in a security document comprising the steps of:

providing at least one laser-markable layer on a security document;

providing at least one reflecting layer on the security document such that the reflecting layer at least partly overlaps with the at least one laser-markable layer, the reflecting layer having at least one transparent region separated by opaque regions, the at least one transparent region and the opaque regions being provided in an overlapping region in which the at least one reflecting layer and the laser-markable layer overlap, wherein the at least one transparent region is surrounded on at least two sides by an opaque region of the at least one reflecting layer, and wherein the opaque regions, seen perpendicularly to the plane of the at least one reflecting layer, are formed as filigree lines with a width in the range from 0.5 to 1000 μm, or are formed as a pattern and/or a grid and/or an area of parallel and/or wavy lines; and laser marking the laser-markable layer with at least one laser beam provided by a laser radiation source, the at least one reflecting layer being arranged between the laser radiation source and the at least one laser-markable layer such that the laser marking forms visually recognizable alphanumeric characters, or strings of characters, symbols, logos, images, photos, captions, lines, biometric data, or fingerprints through the at least one transparent region, wherein the at least one reflecting layer is retained at least visually largely unaltered.

54. A security document comprising;

at least one laser-markable layer;

at least one reflecting layer at least partly overlapping with the at least one laser-markable layer, the reflecting layer having a plurality of transparent regions separated by opaque regions, at least one transparent region being surrounded on at least two sides by an opaque region of the at least one reflecting layer, the at least one transparent region being provided in an overlapping region in which the at least one reflecting layer and the laser-markable layer overlap, seen perpendicularly to the plane of the reflecting layer, and wherein the opaque regions, seen perpendicularly to the plane of the at least one reflecting layer, are formed as filigree lines with a width in the range from 0.5 to 1000 μm, or are formed as a pattern and/or a grid and/or an area of parallel and/or wavy lines; and a contiguous laser marking disposed in the laser-markable layer, the laser marking spanning at least two transparent regions and forming visually recognizable alphanumeric characters, or strings of characters, symbols, logos, images, photos, captions, lines, biometric data, or fingerprints visible to a viewer in at least two adjacent transparent regions, the laser marking being formed independently of the configuration of the transparent regions in the reflecting layer, wherein the laser marking in the laser-markable layer is interrupted under the opaque regions such that this is not visually recognizable for the viewer.

* * * * *